US005376758A

United States Patent [19]

Kimber

[11] Patent Number: 5,376,758

[45] Date of Patent: Dec. 27, 1994

[54] STABILIZED FLEXIBLE SPEAKER CABLE WITH DIVIDED CONDUCTORS

[76] Inventor: Ray L. Kimber, 2752 S. 1900 W., Ogden, Utah 84401

[21] Appl. No.: 162,222

[22] Filed: Dec. 6, 1993

[51] Int. Cl.[5] ..... H01B 11/00

[52] U.S. Cl. ..... 174/128.1; 174/113 C; 174/115; 174/131 A; 174/131 B

[58] Field of Search ..... 174/128.1, 130, 131 R, 174/131 A, 131 B, 113 C, 115, 128.2

[56] References Cited

U.S. PATENT DOCUMENTS

| | | | |
|---|---|---|---|
| 4,084,065 | 4/1978 | Swenson | 174/131 A |
| 4,538,023 | 8/1985 | Brisson | 174/115 |
| 4,743,712 | 5/1988 | Lee | 174/113 C |
| 4,767,890 | 8/1988 | Magnan | 174/115 |
| 4,777,324 | 10/1988 | Lee | 174/115 |
| 4,820,012 | 4/1989 | Asai | 174/131 A |
| 5,266,744 | 11/1993 | Fitzmaurice | 174/113 C |

FOREIGN PATENT DOCUMENTS

| | | | |
|---|---|---|---|
| 232764 | 4/1925 | United Kingdom | 174/131 A |

*Primary Examiner*—Morris H. Nimmo
*Attorney, Agent, or Firm*—A. Ray Osburn

[57] ABSTRACT

A speaker cable assembly having sets of conductors braided about an enlarged flexible core assembly. The enlarged core assembly allows distant spacing of the individual conductors to minimize electromagnetic field interactions to cause signal anomalies. The conductors are spirally wound about the flexible core and held in place by a potted layer of plastic. The core is preferably filled with lead shot to provide weight to insure stability during use and operation.

23 Claims, 2 Drawing Sheets

STABILIZED FLEXIBLE SPEAKER CABLE WITH DIVIDED CONDUCTORS

BACKGROUND OF THE INVENTION

1. Field

The field of the invention is electrical signal transmission cable assemblies for use with audio speakers.

2. State of the Art

Some flexible cable assemblies include multiple electrical conductors. U.S. Pat. No. 4,675,474 discloses parallel or twisted, heavily insulated pump power transmission conductors potted together in a filler material in turn encased in a protective armor covering. The assembly is vulcanized to stabilize the filler material. The resulting assembly has little flexibility, and no capability for providing continuous signal transmission without distortion. The assembly appears to rely upon spirally wrapped, non-conducting, filaments for strength, in cooperation with a tape winding of polypropylene, nylon or the like, and essentially comprises a tube, completely filled with solidified material. The sharp bends needed for speaker cables could not be accommodated. A similar assembly is disclosed in U.S. Pat. No. 3,140,087, wherein the conductors are braided along with non-elastic reinforcing fibers about a solid core of elastic rubberoid material. This assembly is encased in two layers of similar material, so that the bending flexibility is quite limited. The objective of this disclosed assembly is to provide stretchability to the cable without damage to the conductors. The braided non-elastic fiber provides stretch maintained within limits by tightening of the braid about the core. The conductors, braided along with the non-elastic fibers, are protected from damage. The degree of flexibility needed for speaker cables is not provided. No stabilization of conductor position is provided, as needed for fidelity in speaker signal transmission. U.S. Pat. No. 1,305,247 discloses an electrical lead wire assembly having two conductors spirally wound about a core. This subassembly is covered by an elastomeric sheath. The core may be hollow for increased flexibility. No opposite spiralling of the conductors is disclosed. Neither this cable nor any other of the disclosed cables, nor any known speaker cable design, provides enough mass and weight to effectively stabilize the cable from internally induced mechanical vibration by magnetic field interaction, or from air and structure borne vibration from the loudspeaker while it is playing.

A need therefore remains for providing a speaker cable assembly that may be installed in sharply flexed but stable position during operation. Also needed is such an assembly particularly adapted to reduce or eliminate spurious noise and signals from conductor magnetic fields, as well as from external sources.

BRIEF SUMMARY OF THE INVENTION

With the foregoing in mind, the present invention eliminates or substantially alleviates the foregoing disadvantages of the disclosed cables, when used for loudspeaker signal transmission. The inventive cable assembly comprises a number of insulated signal conductor assemblies braided with an equal number of ground conductor assemblies about an elongate, flexible insulative core. The individual conductor assemblies may comprise externally insulated single wires, or insulated multiwire conducting cores. Preferably, however, a braid of three individually insulated conductor wires is used, to substantially suppress the magnetic fields from building about the individual conductor assemblies. The signal conductor assemblies are wound about the core in parallel, spaced apart helixes, and the ground conductor assemblies in identical but oppositely directed helixes equally spaced the same distance. The braided construction assures that all conductor assembly spacing obviates most interaction between induced magnetic fields. The signal and ground conductor assemblies cross nearly perpendicularly, minimizing magnetic field interaction within the cable braid. At each end of the cable assembly, the signal and ground conductor assemblies are each gathered and attached together as a group to respective terminal connectors. A thin potted layer of plastic, for example silicone, surrounds and holds all conductor assemblies permanently in position upon the core.

The central core is a hollow tube of flexible insulative material such as polyvinyl chloride, Teflon® or polypropylene. The core is preferably stiffened against lateral deformation, such as by spaced apart radially outstanding circumferential ribs or hoops. Common vacuum cleaner, or similar hose, would have the requisite lateral crushing resistance and bending flexibility. Local crushing of the core is further resisted by the core being completely filled with selected incompressible material, although the primary function of the fill material is to provide weight to immobilize the cable during use. Preferably, an external sock of knit polyester or the like provides abrasion protection. The fill material is held within the cable assembly by plugs at each end, of epoxy or other plastic.

It is therefore the principal object of the invention to provide an improved flexible speaker cable for high fidelity signal transmission, while minimizing spurious signal distortion from both current induced conductor magnetic field interactions and from external magnetic and mechanical vibration sources.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
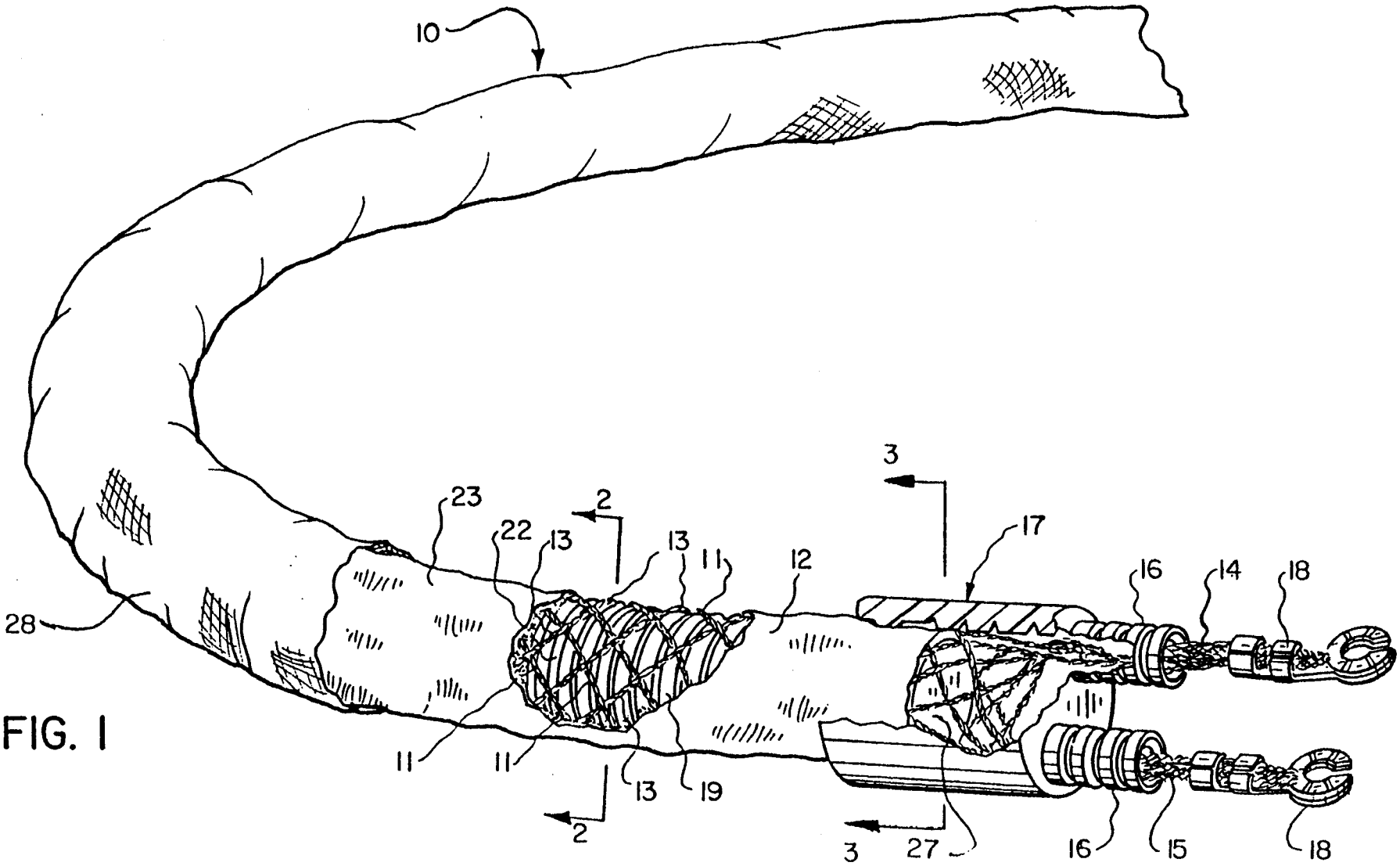
FIG. 1 is a perspective view of a fragment of the speaker cable assembly in accordance with the invention showing the end construction and terminal connectors thereof, and cut away to show the braided multiple conductors thereof, drawn to substantially full scale, FIG. 2 a cross sectional view of the cable assembly of FIG. 1, taken along line 2—2 thereof, drawn to a slightly enlarged scale, FIG. 3 a cross sectional view of the speaker cable assembly of FIG. 1, taken along line 3—3 thereof, showing the shot retaining end plug, drawn to the same scale as FIG. 2, FIG. 4 a view of a typical insulated individual conductor, drawn to enlarged scale, FIG. 5 a view of a fragment of braided individual conductor assembly, drawn to approximately the same scale as that of FIG. 4, FIG. 6 a view of a fragment of another embodiment of the speaker assembly in accordance with the invention, showing the individual conductors arranged in an alternate pattern braided about the core assembly, drawn to approximately the scale of FIG. 3, and FIG. 7 a cross sectional view of another embodiment of the speaker cable assembly in accordance with the invention, showing an alternate pattern for the sets of conductors braided about the core assembly thereof, drawn to the scale of FIG. 6.

A flexible, stabilized speaker cable assembly 10 in accordance with the invention is illustrated in FIG. 1, cut away to show internal details of construction. Cable 10 is characterized by individual insulated conductor assemblies secured generally spaced substantially apart. In the illustrated embodiment, eight signal transmitting conductor assemblies 11 are helically wound parallel and spaced apart about a cable core assembly 12, braided alternately over and under with eight grounding conductor assemblies 13 of identical design, the latter also parallel and spaced apart the same distance but wound in an oppositely directed helix. In the illustrated embodiment, the signal ground conductor assemblies pass successively under two and over two of the opposing ground conductor assemblies 13, and vice versa. At the ends of cable assembly 10, the signal and ground conductor assemblies are each gathered into a single braided or twisted assembly 14 and 15 respectively, to pass through nipples 16 on cable endpiece 17 for connection to post connectors 18, for example.

Figure 5:
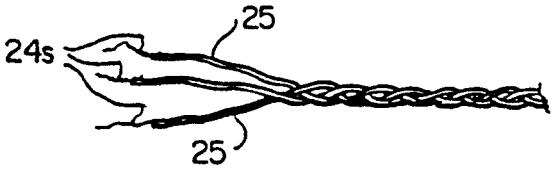

The wide spacing of signal conductor assemblies 11 alleviates or eliminates interaction of the pulsating electromagnetic fields of the individual conductor assemblies, largely precluding spurious signal components from this source. Magnetic field interaction between ground conductor assemblies 13 is similarly minimized or eliminated. Signal and ground conductors are perpendicular where approaching closely together at crossing points, so that spurious currents from magnetic field interactions between signal and ground conductors are also reduced. Assemblies 11 and 13 are preferably constructed by braiding three insulated silver wires 24*s* together. This improves fidelity by largely cancelling the growth of magnetic fields about these individual conductor assemblies. (FIG. 5) The relatively large diameter of cable assembly 10 separates the conductor assemblies much farther than in current speaker cables, additionally preventing the inter-conductor generated spurious signals. As discussed above, the larger diameter of cable 10 is also exploited to provide increased physical stability to cable 10, eliminating much electrical "noise" from cable movement. The conductor assemblies 11 and 13 are preferably equally spaced about core 12 as illustrated, although other cable braid patterns may also provide some of the aforesaid beneficial effects.

Figure 2:
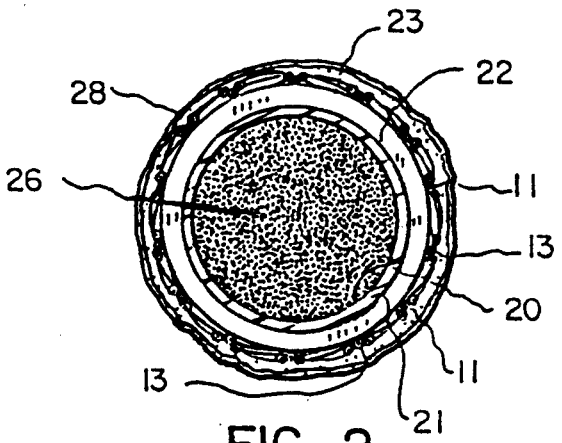

The core 12 of cable assembly 10 comprises an elongate section of corrugated flexible hose 19 of state of the art design of polyvinyl chloride, polyethylene, polypropylene, Teflon ® or other flexible plastic. Hose 19 comprises a smooth walled internal passage 20 formed by a thin wall 21 integral with circumferential, radially extending, hoop-like stiffeners 22 of equal height. (FIG. 2) The circumferential tips 22*t* of stiffeners 22 lie on a cylindrical outer envelope of hose 19. Hose 19 is similar or identical to state of the art hoses used as air conduits for home vacuum cleaners, for example. The hoops prevent collapse of the hose when bent, trod upon or otherwise subjected to lateral crushing forces.

Figure 4:
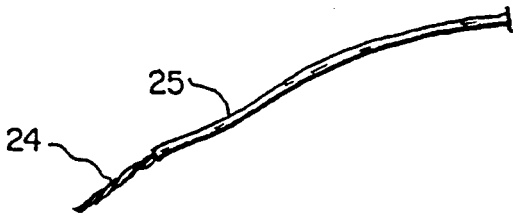

The conductor assemblies 11 and 13 are braided and wound as tightly as possible about hose 19, and are potted in essential spaced apart positions with respect to each other within an encapsulating plastic layer 23, such as silicone or the like. Live and ground conductor assemblies 11 and 13 could, alternately, each comprise a core 24 of conducting material along with a sheath 25 of insulating material. (FIG. 4) Each assembly could have a core 24 of twisted or braided individual wires. A single wire conductor could, if desired, also be used. The multiple strand assemblies however have the advantage of increased flexibility and ease of handling. However, the illustrated three conductor braided assemblies, as noted above, markedly increase the transmission fidelity.

As indicated in the drawings, the encapsulating layer 23 fills the spaces between the hoop spanning helical conductors 11 and 13 and the wall 21 of hose 19. This layer 23 to some extent reduces the flexibility of hose 19. However, it has been found that sufficient flexibility remains; for example, a 1" diameter hose permits bending to 3½" to 4" radii. This bend is much sharper than required in normal speaker cable use.

The total lengths of the individual signal and return conductor assemblies are preferably exactly the same from one cable terminal endpiece 17 to the other. The individual conductor assemblies 11 act together to transmit an identical signal component simultaneously through each. The equality of the individual length maintains the fidelity of the subsequently combined signal, by eliminating any distortion due to tiny variations in signal transmission times. Equal signal and ground lengths also tend to eliminate disturbing "cross talk" due to current phase differences caused by unequal lengths. The common equal lengths of conductor assemblies 11 and 13 are maintained by the alternately over and under cable braid pattern.

Figure 3:
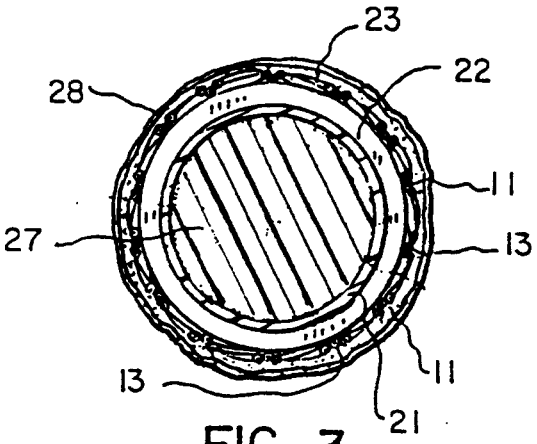

The entire internal volume of corrugated flexible hose 19 may be filled, for example, with an incompressible non-solid material 26, such as a mass of lead shot comprising spherical particles 1/100" in diameter. Shot 26 is not tamped in place, but vibration is used to settle it into all portions of hose passage 20, eliminating any areas of reduced shot density. Cable 10 is then at all points equally resistant to any deforming forces, uniformly stabilized its full length. The shot 26 is retained within the hose passage 20 by an epoxy plug at each of its open ends. (FIG. 3) Possible other incompressible non-solid fill materials 26 include masses of other metallic shots, glass or plastic beads, and granular material such as sand, liquids, thixotropic gels, or the like. The liquid or gel materials could also be advantageously combined with the shot, beads, or sand, for example, to fill the interstices.

Finally, a protective abrasion resistant sock 28 of knit polyester or the like is installed. In total length, the speaker cables 10 can be provided as needed with no basic limitation existing.

Figure 6:
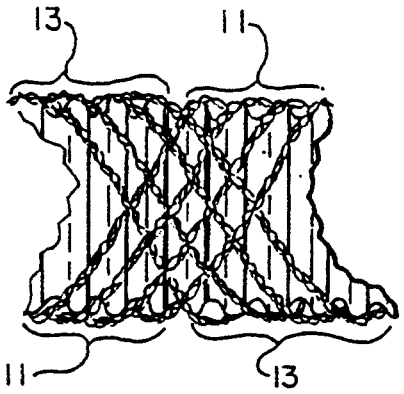
Figure 7:
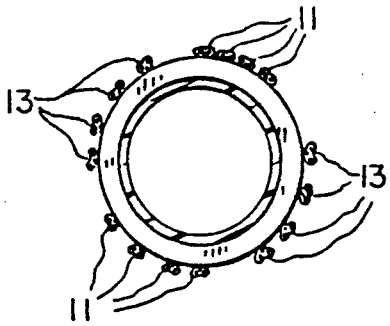

Other embodiments of the speaker cable assembly 10 may be employed without departing from the spirit of the invention. For example, differing numbers of conductors 11 and 13 than illustrated and described may be used. The signal and ground conductor assemblies could, as indicated previously, be braided upon the cable core in different patterns than those illustrated and preferred, without departing from the spirit of the invention. FIG. 6 and 7, for example, show an embodiment with the eight conductor assemblies 11 and 13 not evenly spaced about the core 12, although symmetrically grouped thereabout, still spaced substantially apart and still crossing perpendicularly. The braided conductors could cross at angles departing substantially from perpendicular, with cable assembly 10 still performing very advantageously. And, the conductor assemblies could depart considerably from equal lengths without significant adverse effect upon cable performance. The ribbed core assembly 12 could be replaced with an externally smooth hose, for example, or even with a solid rod of flexible material, such as foam, although such alternatives forego the advantages of lateral core strength. Other means than potting layer 23 could be used to hold conductor assemblies 11 and 13 in fixed position upon the core 12, such as adhesive means, or thermal welding, but probably with less reliable fixation.

The invention may be embodied in still other specific forms without departing from the spirit or essential characteristics thereof. The present embodiments are, therefore, to be considered as illustrative and not restrictive, the scope of the invention being indicated by the appended claims rather than by the foregoing description and all changes that come within the meaning and range of equivalency of the claims are, therefore, intended to be embraced therein.

What is claimed and desired to be secured by United States Letters Patent is:

1. A speaker cable assembly comprising:

an elongate central core member of insulative material substantially the full length of the assembly, having a longitudinal axis of symmetry and an outermost surface;

a pair of sets of electrical conductor assemblies, said sets having equal numbers thereof and each conductor assembly comprising at least one current conducting member covered by an insulating sheath, the conductor assemblies of both sets being symmetrically positioned about the longitudinal axis of the core, with said assemblies of one of said sets being wound in spaced apart, parallel, helical paths the full length of the core member upon the outermost surface thereof, and said assemblies of the other set being wound equally spaced apart in identical but oppositely directed helical paths the full length of the core member; wherein the conductor assemblies of the two sets thereof are braided together about and in contact with the core assembly; and wherein said cable assembly further comprises means securing each of the conductor assemblies in fixed position upon the outermost surface of the core member.

2. The speaker assembly of claim 1, wherein:

the helical paths are selected so that the conductor assemblies of each set everywhere cross said assemblies of the other set substantially perpendicularly.

3. The speaker cable assembly of claim 1, wherein:

the conductor assembly securing means comprises a layer of plastic material potted and cured upon the outermost surface of the core member to cover and surround the conductor assemblies.

4. The speaker cable assembly of claim 2, wherein:

the conductor assembly securing means comprises a layer of plastic material potted and cured upon the outermost surface of the core member to cover and surround the conductor assemblies.

5. The speaker cable assembly of claim 4, wherein:

the conductor assemblies each comprise a single current conducting member covered by an insulating sheath.

6. The speaker cable assembly of claim 4, wherein:

the conductor assemblies each comprise a set of three current conducting members each covered by an insulating sheath, said sheath covered members being braided together.

7. The speaker cable assembly of claim 1, wherein:

the central core member is tubular, having a central passage the full length thereof.

8. The speaker cable assembly of claim 2, wherein:

the central core member is tubular, having a central passage the full length thereof.

9. The speaker cable assembly of claim 4, wherein:

the central core member is tubular, having a central passage the full length thereof.

10. The speaker cable assembly of claim 6, wherein:

the central core member is tubular, having a central passage the full length thereof.

11. The speaker cable assembly of claim 7, further comprising:

incompressible non-solid material completely filling the passage through the core member; and an incompressible solid material retaining plug closing the passage at each end thereof.

12. The speaker cable assembly of claim 10, further comprising:

incompressible non-solid material completely filling the passage through core member; and an incompressible solid material retaining plug closing the passage at each end thereof.

13. The speaker cable assembly of claim 11, wherein:

the incompressible non-solid material is selected from among masses of metallic shot, masses of glass beads, masses of plastic beads, masses of sand, liquids and gels.

14. The speaker cable assembly of claim 12, wherein:

the incompressible non-solid material is selected from among masses of metallic shot, masses of glass beads, masses of plastic beads, masses of sand, liquids and gels.

15. The speaker cable assembly of claim 11, wherein:

the incompressible non-solid material is selected to be a mixture comprising at least one material selected from among liquids and gels, along with at least one mass of material selected from among metallic shot, glass beads, plastic beads, and sand.

16. The speaker cable assembly of claim 12, wherein:

the incompressible non-solid material is selected to be a mixture comprising at least one material selected from among liquids and gels, along with at least one mass of material selected from among metallic shot, glass beads, plastic beads, and sand.

17. The speaker cable assembly of claim 2, wherein:

the electrical conductor assemblies of each of the pair of sets thereof are gathered together at each end of the core member into a single conducting device.

18. The speaker cable assembly of claim 4, wherein:

the electrical conductor assemblies of each of the pair of sets thereof are gathered together at each end of the core member into a single conducting assembly secured to a terminal connecting device.

19. The speaker cable assembly of claim 6, wherein:

the electrical conductor assemblies of each of the pair of sets thereof are gathered together at each end of the core member into a single conducting assembly secured to a terminal connecting device.

20. The speaker cable assembly of claim 12, wherein:

the electrical conductor assemblies of each of the pair of sets thereof are gathered together at each end of the core member into a single conducting assembly secured to a terminal connecting device.

21. The speaker cable assembly of claim 13, wherein: the electrical conductor assemblies of each of the pair of sets thereof are gathered together at each end of the core member into a single conducting assembly secured to a terminal connecting device.

22. The speaker cable assembly of claim 14, wherein: the electrical conductor assemblies of each of the pair of sets thereof are gathered together at each end of the core member into a single conducting assembly secured to a terminal connecting device.

23. The speaker cable assembly of claim 15, wherein: the electrical conductor assemblies of each of the pair of sets thereof are gathered together at each end of the core member into a single conducting assembly secured to a terminal connecting device.

* * * * *